US007118203B2

(12) United States Patent
Davis et al.

(10) Patent No.: US 7,118,203 B2
(45) Date of Patent: Oct. 10, 2006

(54) PERISTALTIC PUMP

(75) Inventors: Jeremy A. Davis, Battle Ground, WA (US); Melissa S. Gedraitis, Camas, WA (US); Kevin D. Koller, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 494 days.

(21) Appl. No.: 10/647,496

(22) Filed: Aug. 25, 2003

(65) Prior Publication Data

US 2005/0047946 A1 Mar. 3, 2005

(51) Int. Cl.
*B41J 2/175* (2006.01)
*F04B 43/12* (2006.01)

(52) U.S. Cl. ..... 347/85; 417/475; 417/477.11

(58) Field of Classification Search ..... 347/85; 417/475, 477.9, 477.11
See application file for complete search history.

(56) References Cited

U.S. PATENT DOCUMENTS 1,493,292 A * 5/1924 Sweeney ..... 56/400.2
2,968,974 A * 1/1961 Everett ..... 72/339
3,431,864 A * 3/1969 Jones, Jr. ..... 417/475
3,679,331 A 7/1972 Kushner
3,723,030 A 3/1973 Gelfand
3,739,717 A 6/1973 Brown et al.
3,740,173 A 6/1973 Natelson
3,791,777 A 2/1974 Papoff et al.
3,818,688 A * 6/1974 Drummond et al. ..... 56/400.01
3,832,096 A 8/1974 Gelfand
4,025,241 A * 5/1977 Clemens ..... 417/477.11
4,473,342 A * 9/1984 Iles ..... 417/477.11
4,544,336 A 10/1985 Faeser et al.
4,547,136 A 10/1985 Rothstein
4,886,431 A 12/1989 Soderquist et al.
4,976,593 A 12/1990 Miyamoto
5,083,908 A * 1/1992 Gagnebin et al. ..... 417/477.11
5,096,393 A 3/1992 Van Steenderen et al.
5,098,261 A 3/1992 Bertoncini
5,257,917 A 11/1993 Minarik et al.
5,447,417 A 9/1995 Kuhl et al.
5,460,493 A * 10/1995 Deniega et al. ..... 417/475
5,549,461 A * 8/1996 Newland ..... 417/477.11
5,846,061 A 12/1998 Ledebuhr et al.
5,934,057 A * 8/1999 Daniels et al. ..... 56/400.21
6,033,060 A 3/2000 Minami
6,082,851 A 7/2000 Shiloh et al.
6,419,466 B1 7/2002 Lowe et al.

* cited by examiner

*Primary Examiner*—Michael Koczo, Jr.

(57) ABSTRACT

An occlusion for use in a peristaltic pump includes independently movable occlusion fingers. The fingers are integrally formed as a single unitary body.

39 Claims, 8 Drawing Sheets

PERISTALTIC PUMP

BACKGROUND OF THE INVENTION

Peristaltic pumps are utilized to move liquid through tubes. Peristaltic pumps typically include a plurality of rollers which are rotated against fluid-filled tubes to compress the tubes against a plurality of occlusions to move the fluid within the tubes. Peristaltic pumps are very susceptible to the physical difference or gap between the rollers and the occlusion. If the gap is too large, the pump does not move fluid within the tubes. If the gap is too small, the tubes are excessively compressed which requires additional torque to move the pump and which increases wear of the tubes.

Known peristaltic pumps include adjustable occlusions for each tube through which fluid is being pumped. Manual adjustment of each occlusion relative to the rollers enables the user to accommodate manufacturing variances which result in varying gap distances between the rollers and the individual occlusions. Examples of such peristaltic pumps are disclosed in U.S. Pat. Nos. 6,063,060; 5,096,393; and 4,886,431.

DETAILED DESCRIPTION OF THE EXAMPLE EMBODIMENTS

Figure 1:
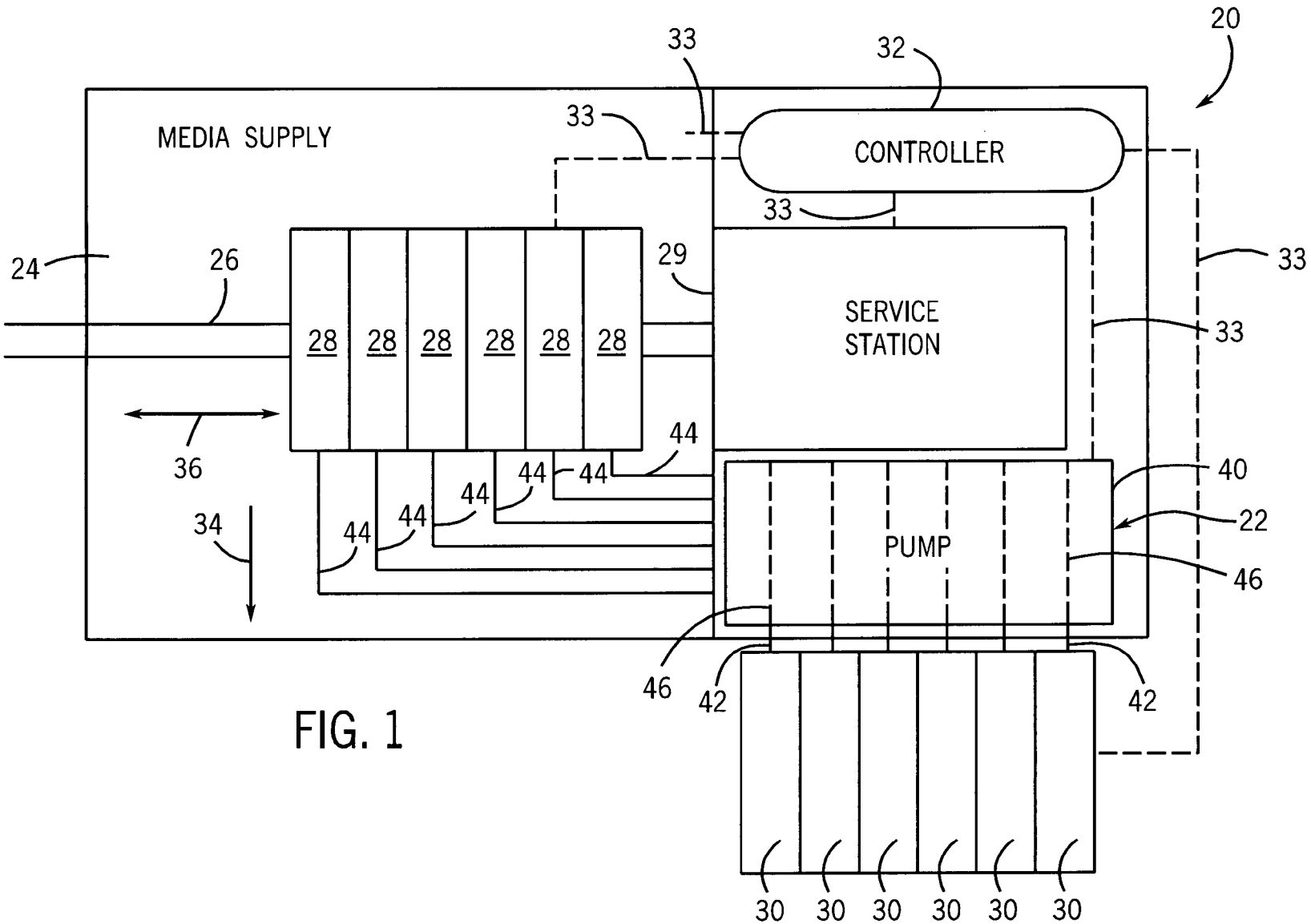
FIG. 1 schematically illustrates an image-forming device including an example of a peristaltic pump of the present invention.

FIG. 1 schematically illustrates printer 20 utilizing one example of a fluid delivery system 22 of the present invention. In addition to fluid delivery system 22, printer 20 includes media supply 24, carriage 26, pens 28, ink supplies 30 and controller 32. Media supply 24 comprises a conventionally known or future developed mechanism configured to supply and position media, such as paper, relative to carriage 26 and pens 28. Carriage 26 comprises a conventionally known or future developed mechanism for moving pens 28 relative to the medium provided by media supply 24. In the particular embodiment illustrated, media supply 24 moves the medium relative to carriage 26 and pens 28 in the direction indicated by arrow 34 while carriage 26 moves pens 28 repeatedly across the medium in the directions indicated by arrow 36.

Pens 28 (also known as "print cartridges") comprise conventionally known or future developed pens including printheads with nozzles for dispensing fluid ink upon the medium. Service station 29 is a conventionally known service station configured to service pens 28. Examples of servicing operations include wiping, spitting, and capping. Ink supplies 30 provide ink reservoirs containing one or more chromatic or achromatic inks to pens 28. Ink supplies 30 and fluid delivery system 22 function as an ink supply system for printer 20.

Fluid delivery system 22 moves ink from ink supplies 30 to pens 28. Fluid delivery system 22 includes peristaltic pump 40 and fluid ink conduits 42, 44. As will be described in greater detail hereafter, peristaltic pump 40 includes pumping tubes 46. Fluid conduits 42 fluidly connect the ink reservoirs provided by ink supplies 30 to pumping tubes 46. Fluid conduits 44 fluidly interconnect pumping tubes 46 to pens 28. The actual length of conduits 42 and 44 may vary depending upon the actual proximity of ink supplies 30, pump 40 and maximum/minimum distance between pens 28 and pump 40. In particular applications, conduits 42 and 44 are releasably connected to pumping tubes 46 by fluid couplers. In alternative embodiments, one of conduits 42, 44 or both of conduits 42, 44 may be integrally formed as part of a single unitary body with pumping tubes 46. In the embodiment shown, conduits 42 and 44 have a smaller cross sectional flow area as compared to pumping tubes 46 such that pumping tubes 46 may be sized for higher pumping rates. In alternative embodiments, conduits 42, 44 and pumping tubes 46 may have similar internal cross sectional flow areas. In another embodiment, each of the plurality of conduits 44, each of the plurality of conduits 42 and each of the plurality of tubes 46 are substantially identical to one another. In alternative embodiments, pump 40 may be provided with different individual pumping tubes 46, different individual conduits 42 or different individual conduits 44. Although pumping tubes 46 include a flexible wall portion enabling pumping tubes 46 to be compressed, conduits 42 and 44 may be provided by flexible tubing or may be provided by inflexible tubing or other structures having molded or internally formed fluid passages. Although printer 20 is illustrated as having six pens 28, six ink supplies 30, six pumping tubes 46, six conduits 42 and six conduits 44, printer 20 may alternatively have a greater or fewer number of such components depending upon the number of different inks utilized by printer 20.

Controller 32 communicates with media supply 24, carriage 26, pens 28, ink supplies 30 and fluid delivery system 22 via communication lines 33 in a conventionally known manner to form an image upon medium 24 utilizing ink supplied from ink supplies 30. Controller 32 comprises a conventionally known processor unit. For purposes of this disclosure, the term "processor unit" shall include a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 32 is not limited to any specific combination of hardware circuitry and software, nor to any particular source for the instructions executed by the processing unit.

Although fluid delivery system 22 is illustrated as being employed in a printer 20 in which both the medium 25 and pens 28 are moved relative to one another to form an image upon a medium, fluid delivery system 22 may alternatively be employed in other printers to move fluid ink from one or more ink supplies to one or more ink-dispensing printheads or nozzles. For example, fluid delivery system 22 may alternatively be employed in a printer in which ink-dispensing nozzles are provided across a medium as the medium is moved in the direction indicated by arrow 34. This printer is commonly referred to as a page-wide-array printer. In still other embodiments, fluid delivery system 22 may be employed in other image-forming devices where fluid ink is deposited upon a medium by means other than pens or printheads or wherein the medium itself is held generally stationary as the ink is deposited upon the medium. Overall, fluid delivery system 22 may be utilized in any image-forming device which utilizes ink or other fluid to be deposited upon a medium.

Figure 2:
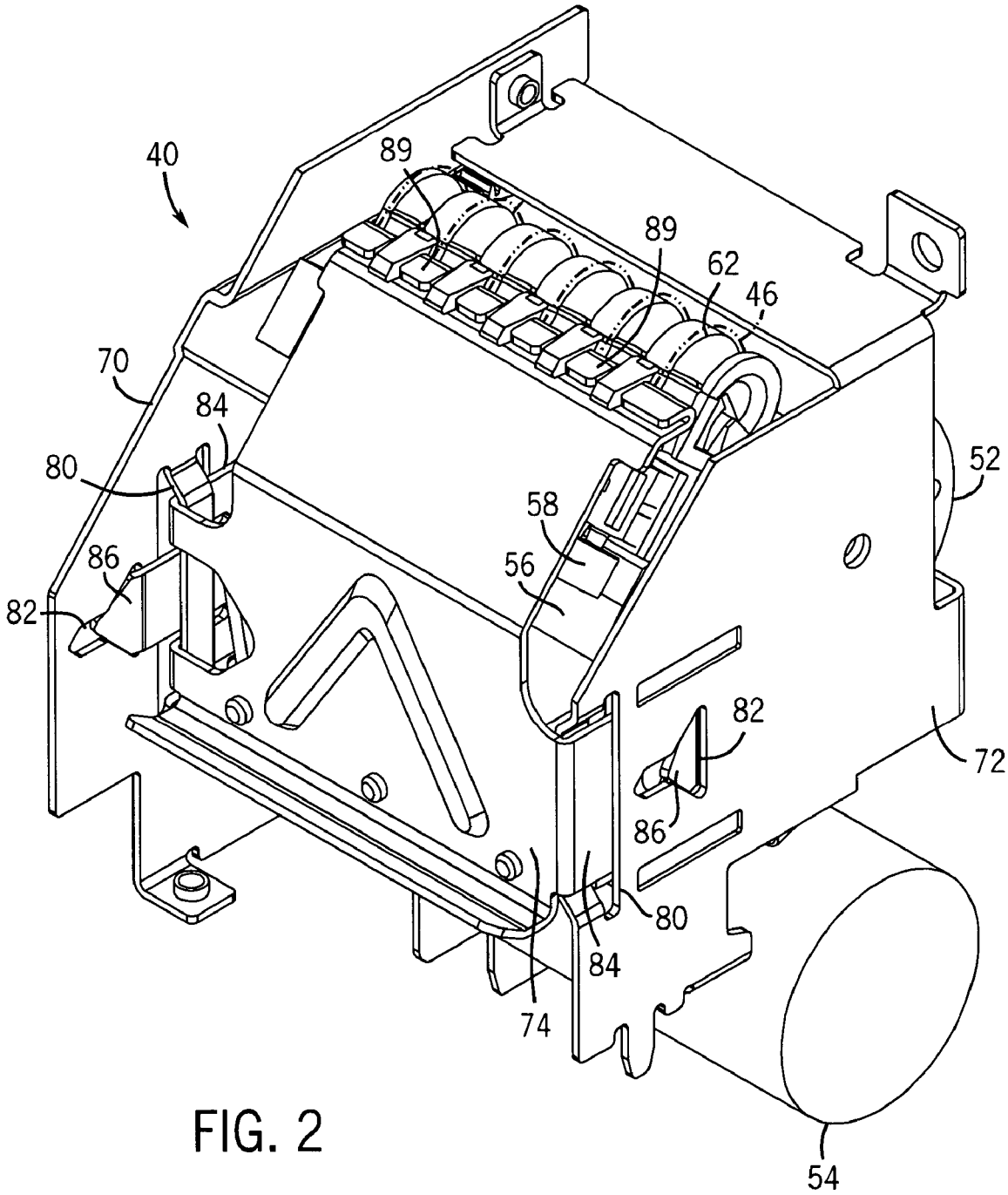
FIG. 2 is a top perspective view of one embodiment of the peristaltic pump of FIG. 1.
Figure 3:
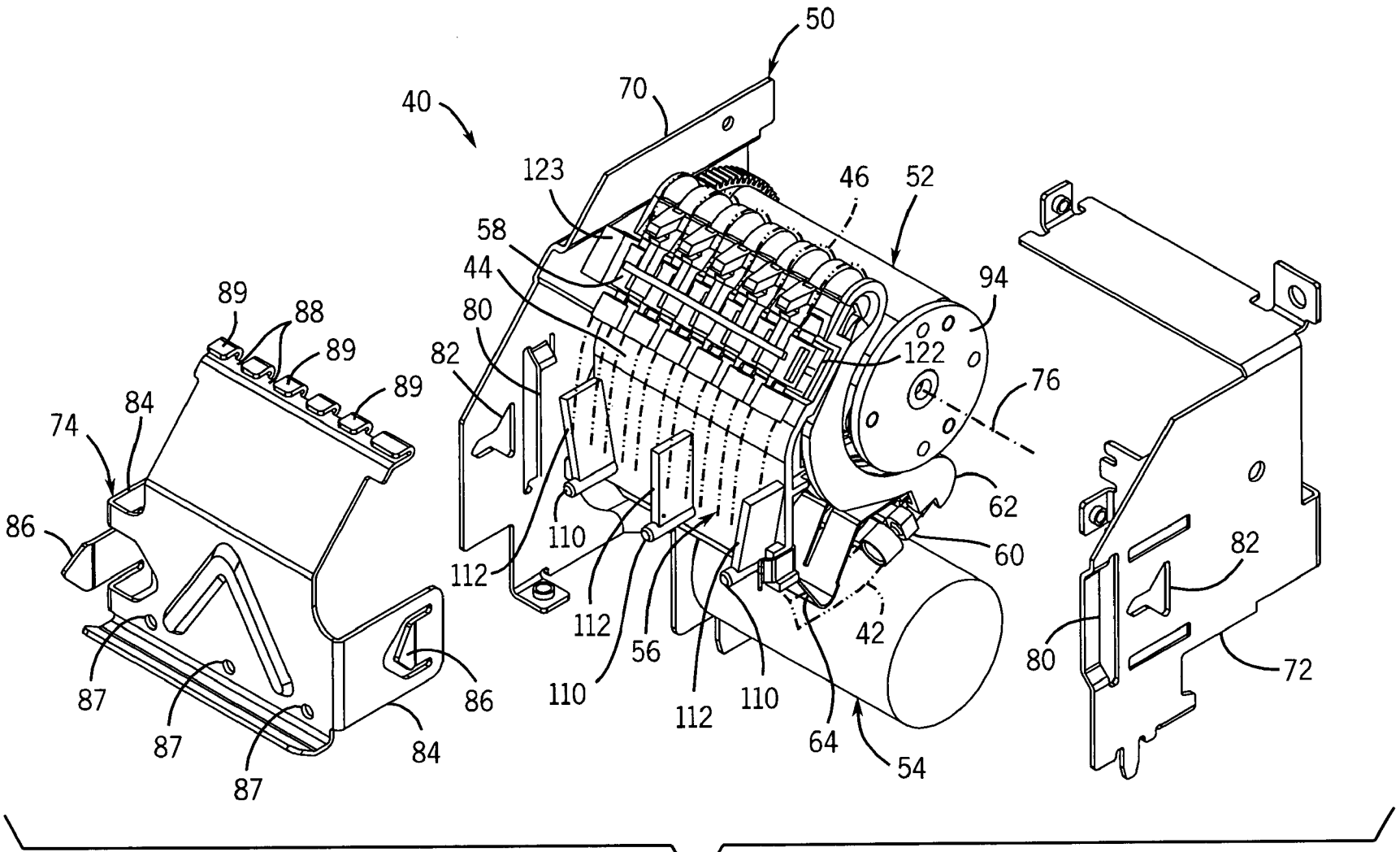
FIG. 3 is a top perspective view of the peristaltic pump of FIG. 2 with portions exploded away for purposes of illustration.

FIGS. 2–7 illustrate peristaltic pump 40 in greater detail. As shown by FIG. 3, pump 40 generally includes pumping tubes 46, housing 50, movable occluding member 52, occluding member drive system 54, holder 56, fluid couplers 58, 60, occlusion 62 (also referred to as an "occlusion bed") and spring system 64. Pumping tubes 46 comprise elongate tubes fluidly coupled to each of conduits 42 and 44 by couplers 58 and 60. For purposes of this disclosure, the terms "fluidly coupled," "in fluid communication" or "in fluid connection" shall mean two or more members having fluid containing volumes that are connected or plumbed to one another by one or more fluid passages enabling fluid to flow between the volumes in one or both directions. Such fluid flow may be temporarily cessated by selective actuation of valve devices.

Tubes 46 extend between occluding member 52 and occlusion 62 and include at least a portion of a wall that is flexible, enabling occluding member 52 to compress tubes 46 against occlusion 62. Tubes 46 generally have an internal cross sectional diameter larger than the internal cross sectional diameter of conduits 42 and 44 to achieve higher fluid pumping rates. Although tubes 46 are generally illustrated as having a circular cross sectional shape, tubes 46 may have other alternative cross sectional shapes, wherein at least a portion of the tube is flexible. In the embodiment shown, tubes 46 are formed from one or more polymeric materials. Tubes 46 may be formed from a single layer or multiple layers. Tubes 46 may be homogenous in nature or may be formed from a plurality of mixed materials. One example of a material from which tubes 46 may be formed is SANTOPRENE thermoplastic elastomer which is currently sold by Advanced Elastomers, Inc.

Housing 50 encloses and at least partially supports the remaining components of pump 40. Housing 50 includes side plates 70, 72 and retainer 74. Side plates 70 and 72 comprise metal plates extending on opposite sides of pump 40 and configured to cooperate with one another so as to rotatably support occluding member 52 for rotation about axis 76.

Retainer 74 comprises a metal plate fixedly coupled to one or both of side plates 70, 72 and is generally configured to extend opposite holder 56. Retainer 74 cooperates with holder 56 to guide and direct the flexible tubes constituting conduits 44. As a result, retainer 74 and holder 56 facilitate management of such tubes, enabling pump 40 and printer 20 (shown in FIG. 1) to be organized and compact.

In the particular embodiment illustrated, side plates 70 and 72 are fastened to one another and include channels 80 and slots 82. Retainer 74 includes tabs 84 and prongs 86. Upon housing 50 being assembled, channels 80 receive tabs 84. During insertion of tabs 84 through channels 80, prongs 86 resiliently deflect inwardly until being moved across from slots 82. Prongs 86 project through slots 82 to releasably secure retainer 74 to side plates 70, 72 without the need for fasteners. Consequently, assembly is simplified and fewer parts are required.

As further shown by FIG. 3, retainer 74 includes a plurality of features for aligning and supporting holder 56. In particular, retainer 74 includes openings 87, edge portions 88 and spacers 89. Openings 87 comprise detents configured to receive corresponding projections extending from holder 56. In the particular embodiment illustrated, openings 87 are configured to receive posts. In alternative embodiments, openings 87 may be configured to releasably receive other forms of projections. In still other embodiments, retainer 74 may utilize other forms of detents such as depressions for receiving projections extending from holder 56.

Edge portions 88 and spacers 89 enable retainer 74 to be keyed to holder 56. Spacers 89 form widened or thickened portions along an edge of retainer 74. As will be described hereafter, edge portions 88 and spacers 89 facilitate securement and precise alignment of retainer 74 to holder 56.

Although illustrated as being formed from three interlocking plates, housing 50 may have a variety of other configurations in alternative embodiments. For example, housing 50 may alternatively be provided by a greater or fewer number of individual components fastened to one another, releasably interlocked to one another or integrally formed as part of a single unitary body with one another. In lieu of being formed out of sheet metal, portions of housing 50 may alternatively be formed from polymers or other materials having appropriate strength and durability characteristics.

Figure 5:
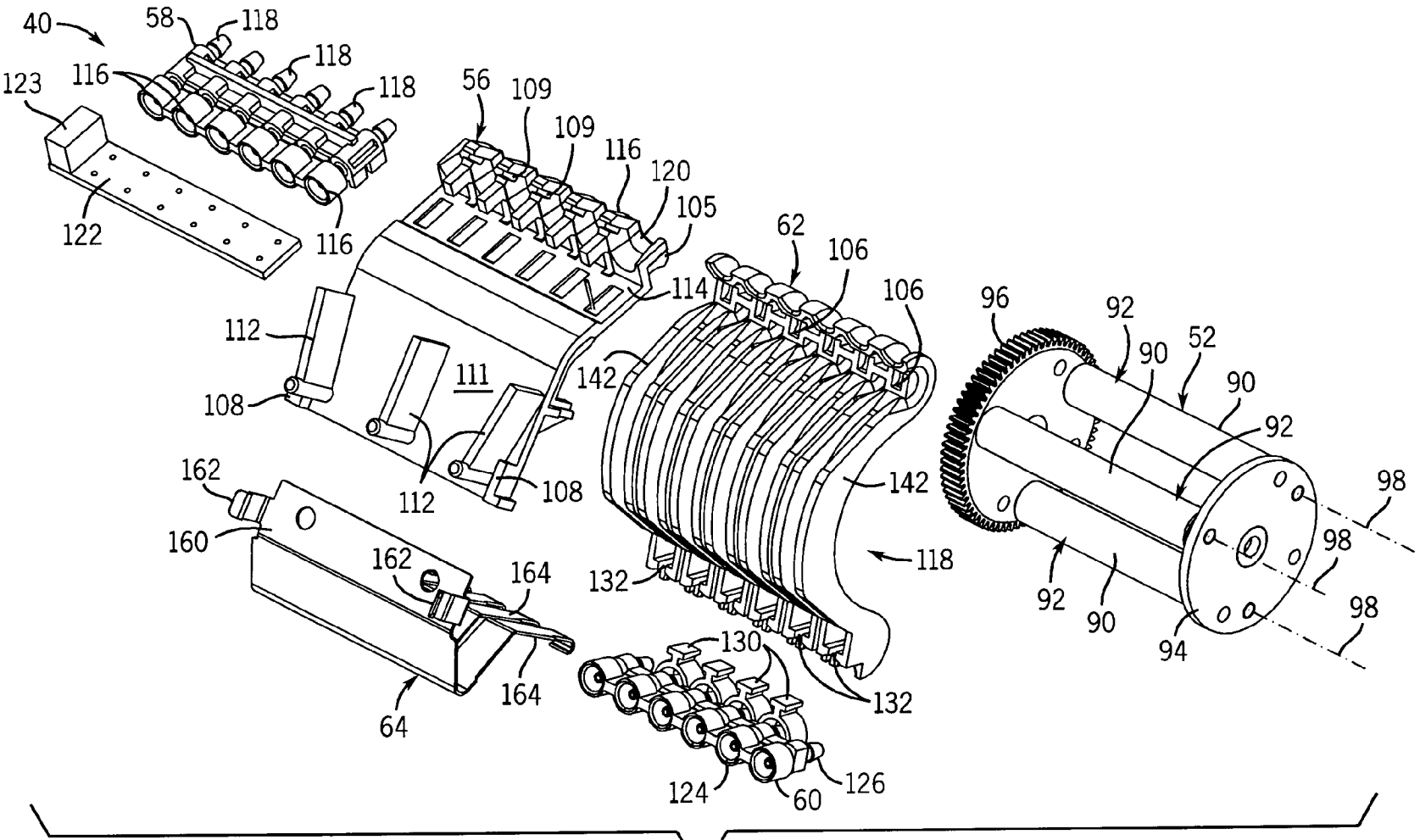
FIG. 5 is an exploded perspective view of the peristaltic pump of FIG. 2 with portions removed for purposes of illustration.

As shown by FIG. 5, movable occluding member 52 includes a plurality of occluding surfaces 90 which are configured to be moved while in engagement or contact with pumping tubes 46 so as to compress pumping tubes 46. In particular, occluding surfaces 90 are configured to be rotated about axis 76 by drive system 54 along a circular path to compress tubes 46 against occlusion 62 so that fluid ink within tubes 46 is moved towards or away from pens 28 (shown in FIG. 1). In the particular embodiment illustrated, occluding surfaces 90 are rotated in a forward or push direction to overfill pens 28. Occlusion members 90 are then rotated in a reverse direction about axis 76 to withdraw some ink to reset the volume of ink within pens 28 to a known value. In alternative embodiments, pump 40 may only be configured to move occluding surfaces 90 in a first direction about axis 76 so as to pump ink only towards pens 28.

In the particular embodiment illustrated, occluding member 52 generally comprises a roller assembly including a plurality of rollers 92 rotatably supported by end portions 94, 96 for rotation about axes 98. Rollers 92 provide occluding surfaces 90. In other alternative embodiments, occluding surfaces 90 may alternatively be provided by other conventionally known or future developed structures or mechanisms which provide a surface that is moved in some fashion while in engagement with pumping tubes 46.

To pump fluid through tubes 46, at least one of rollers 92 must be in engagement with tubes 46. In the particular embodiment illustrated, rollers 92 are spaced approximately 120° apart from one another about axis 76 (shown in FIG. 3). As a result, in the illustrated embodiment, occlusion 62 extends at least 120 degrees about axis 76. In alternative embodiments, occluding member 52 may be provided with a greater or fewer number of rollers 92 and the extent that occlusion 62 extends about axis 76 may also vary. Generally, according to some embodiments, increasing the number of rollers 92 enables occlusion 62 to be configured so as to wrap about axis 76 to a lesser extent. However, increasing the number of rollers 92 on occluding member 52 reduces the rate at which fluid is being pumped at a given speed since the rollers take up space on tubes 46. As a result, it may be necessary to rotate occluding member 52 at a higher speed to achieve necessary pumping rates. In lieu of being rotatably supported by end portions 94, 96, rollers 92 may alternatively generally fixed against such rotation.

End portions 94, 96 extend on opposite ends of rollers 92. End portions 94 and 96 are rotatably coupled to housing 50 for rotation about axis 76. In the particular embodiment illustrated, end portion 96 comprises a toothed gear for interacting with drive system 54. In alternative embodiments, end portion 96 may omit such teeth and may be coupled to another toothed gear. In still other embodiments, end portion 96 may have other configurations depending upon the drive train to which it is coupled. For example, end portion 96 may alternatively include a sprocket or a pulley.

Figure 4:
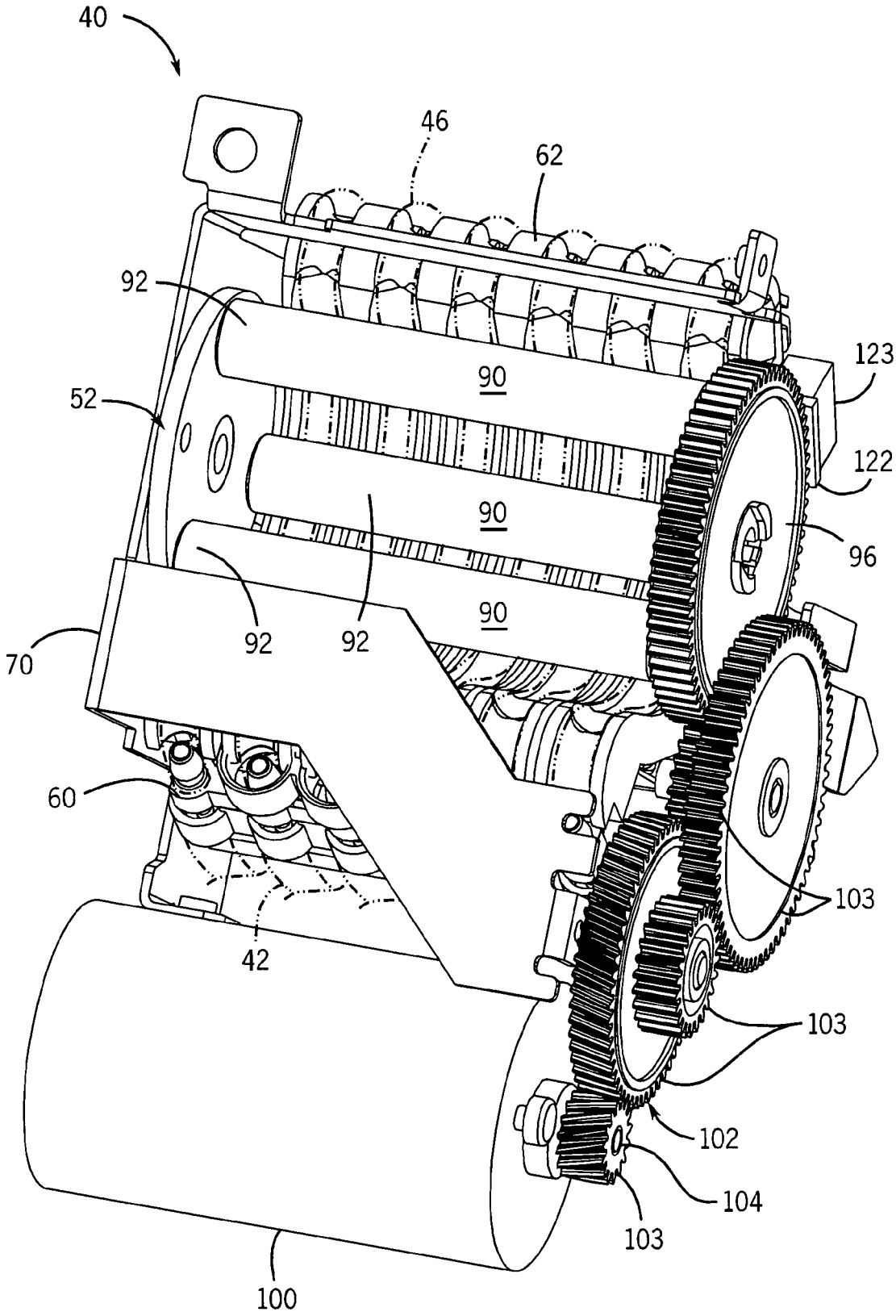
FIG. 4 is a bottom perspective view of the peristaltic pump of FIG. 2 with portions removed for purposes of illustration.

Drive system 54 moves occluding member 52 relative to pumping tubes 46 and occlusion 62. In the particular embodiment illustrated, system 54 rotates member 52 about axis 76. As shown by FIG. 4, drive system 54 generally includes rotary actuator 100 and drive train 102. Rotary actuator 100 comprises a device configured to generate rotational mechanical energy or torque. In the particular embodiment illustrated, rotary actuator 100 comprises a conventionally known electrically powered motor having an output shaft 104. In alternative embodiments, rotary actuator 100 may comprise other pneumatic, hydraulic or otherwise powered rotary actuators.

Drive train 102 comprises a conventionally known or future developed power train configured to transmit power or torque from output shaft 104 of rotary actuator 100 to member 52. In the particular embodiment illustrated, drive train 102 is configured to reduce the speed and increase the torque being provided to member 52. As shown by FIG. 4, drive train 102 comprises a plurality of intermeshing gears 103, wherein the end-most gear 103 is in meshing engagement with end portion 96 of member 52. In alternative embodiments, drive train 102 may comprise other drive train mechanisms such as chain and sprocket or belt and pulley arrangements. In still other embodiments, drive train 102 may be omitted, wherein rotary actuator 100 is directly coupled to occluding member 52.

Holder 56 generally comprises a structure configured to support spring system 64 relative to occlusion 62 and to couple occlusion 62 and spring system 64 to housing 50. In the particular embodiment illustrated, holder 56 is releasably coupled to both spring system 64 and occlusion 62 without fasteners. In particular, holder 56 includes plurality of projecting teeth 105 which are received within corresponding openings 106 formed in occlusion 62. Teeth 105 cooperate with openings 106 to retain holder 56 relative to occlusion 62. To facilitate connection of holder 56 to spring system 64, holder 56 additionally includes catches 108 for mounting spring system 64 to holder 56.

Holder 56 is further releasably coupled to retainer 74 and housing 50 by slots 109 and retention posts 110. Slots 109 comprise openings spaced from one another and configured to mate or key with edge portions 88 and spacers 89 of retainer 74. As shown by FIG. 2, slots 109 (shown in FIG. 5) receive portions 88 (shown in FIG. 3) while being interleaved with spacers 89 to precisely align holder 56 and the remaining components of pump 40 relative to one another. In alternative embodiments, other structures may be used to precisely key or align retainer 74 to holder 56.

Retention posts 110 project from holder 56 and through corresponding openings 87 within retainer 74. As a result, posts 110 retain holder 56 relative to retainer 74 along two orthogonal axes while slots 109 retain holder 56 relative to retainer 74 along the third orthogonal axis.

In addition to supporting spring system 64 relative to occlusion 62, holder 56 also guides and directs conduit 44 to prevent fluid conduit 44 from becoming tangled or undesirably pinched. Holder 56 extends opposite to and is spaced from front retainer 74 so as to form an internal passage for containing and guiding conduits 44. In particular, holder 56 includes surface 111 against and along which conduits 44 extend. In addition, Holder 56 includes channeling members 112. Channeling members 112 extend from surface 111 and are configured to engage, direct, separate and organize conduits 46 extending from fluid couplers 58. In the particular embodiment illustrated, channeling members 112 comprise paddles adjustably and pivotally coupled to surface 111 by posts 110. In alternative embodiments, channeling members 112 may be fixedly coupled to surface 90 so as not to rotate. In still other alternative embodiments, channel member 112 may be integrally formed as part of a single unitary body with surface 111.

In the particular pump shown, fluid conduits 44 are releasably interconnected to pumping tubes 46 by fluid couplers 58. Holder 56 provides a structure which assures the proper alignment of fluid couplers 58 with occlusion 62. As shown by FIG. 5, holder 56 includes platform 114 and tube partitions 116. Platform 114 provides a surface upon which fluid couplers 58 may be mounted relative to and in close proximity with occlusion 62. Tube partitions 116 extend adjacent to platform 114 and the front face 118 of occlusion 62. Partitions 116 are generally configured to extend between adjacent pumping tubes 46 as pumping tubes 46 extend from front face 118 into connection with fluid couplers 58. Adjacent partitions 116 form a plurality of smooth channels or grooves 120 which receive pumping tubes 46 to prevent the development of sharp bends in tubes 46. Grooves 120 further facilitate assembly of pump 40 by assisting in the connection of pumping tubes 46 to their respective fluid couplers 58.

Fluid couplers 58 generally comprise a plurality of devices configured to fluidly connect conduits 44 to pumping tubes 46. In other words, couplers 48 enable fluid to flow at least in one direction between conduits 44 and pumping tubes 46. Each of coupler 48 generally includes a first coupling portion 116 and a second coupling portion 118. Coupling portion 116 is configured to be releasably connected to conduit 42 while coupling portion 118 is configured to be releasably coupled to a pumping tube 46. An internal fluid passage extends from and through portions 116 and 118. Couplers 58 enable conduits 44 and tubes 46 to have different sizes and configurations such that tubes 46 may be optimized for pumping without requiring the same configuration for conduits 44. In particular embodiments, couplers 58 may additionally include valving mechanisms for selectively controlling the flow of fluid between conduits 44 and tubes 46.

In the particular embodiment illustrated, pump 40 is additionally configured to sense or monitor the flow of ink through tubes 46. Pump 40 includes printed circuit board 122 and connector 123. Printed circuit board 122 is mounted to platform 114 and supports couplers 58. Printed circuit board 122 is electrically connected to a fluid sensor positioned along the fluid paths created by coupler 58 and conduit 44. In the embodiment shown, this fluid sensor comprises a pair of electrical leads (not shown) which are formed within coupler 58 and which project into the internal fluid passage of couplers 58. The electrical leads sense the presence of fluid, such as ink, within couplers 58. Such signals are transmitted across printed circuit board 122 to connector 123. Connector 123 electrically connects printed circuit board 122 to an electrical cable, a flexible circuit or other electrical connection means which is in turn electrically connected to controller 32. In the embodiment shown, controller 32 utilizes the detected presence or absence of fluid within couplers 58 in generating control signals for operating motor 100. In alternative embodiments, printed circuit board 122, connector 123 and the electrical leads provided as part of couplers 58 may be omitted, wherein couplers 58 are directly mounted to platform portion 114.

Fluid couplers 60 comprise a plurality of devices configured to fluidly connect conduits 42 to pumping tubes 46. Each fluid coupler 60 includes a first coupling portion 124 and a second coupling portion 126, wherein a continuous fluid passage is formed through portions 124 and 126. Portion 124 is configured to be releasably connected to fluid conduit 42. Portion 126 is configured to be releasably connected to pumping tube 46. Like couplers 58, couplers 60 enable conduit 42 to have distinct characteristics as compared to tubes 46 and enable tubes 46 to be optimized for pumping. In alternative embodiments, couplers 60 may additionally include fluid sensing devices for sensing the flow or presence of fluid within couplers 60 or valving mechanisms for selectively controlling the flow of fluid between conduits 42 and tubes 46.

Fluid couplers 60 are generally arranged opposite to fluid couplers 58 on opposite ends of occlusion 62. As shown by FIG. 5, fluid couplers 60 are formed or arranged as a single unit which is mounted to occlusion 62 adjacent the front face 118 of occlusion 62. In particular, fluid couplers 60 include a plurality of T-shaped tongues 130 which mate within a corresponding plurality of grooves 132 formed as part of occlusion 62. As a result, fluid couplers 60 are supported relative to occlusion 62 without the need for fasteners, simplifying assembly. In addition, tongues 130 move within grooves 132 so as to not interfere with the movement of portions of occlusion 62 relative to one another. In alternative embodiments, fluid couplers 60 may be releasably coupled to occlusion 62 by other conventionally known or future developed fastening or mounting arrangements.

Figure 6:
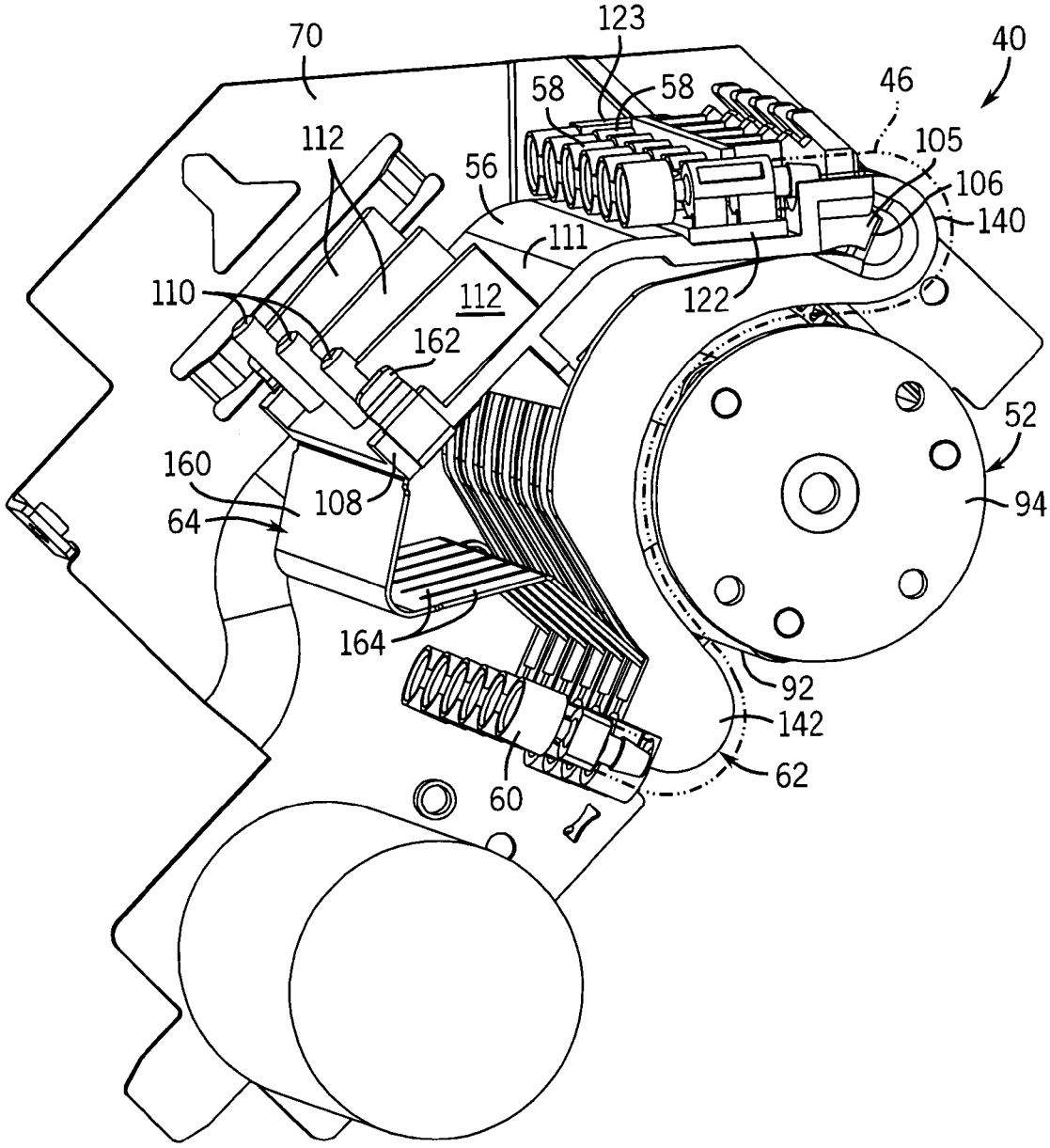
FIG. 6 is an enlarged fragmentary perspective view of the peristaltic pump of FIG. 2 with portions removed for purposes of illustration.

Fluid couplers 58 and 60 serve as anchor points to maintain tubes 46 in appropriate tension across face 118 of occlusion 62. As shown by FIG. 6, fluid couplers 58 and 60 are supported at the opposite ends of occlusion 62 adjacent to face 118. In the embodiment illustrated, this is facilitated by the mounting of couplers 58 upon holder 56 along a top end of occlusion 62 and the direct mounting of couplers 58 to a lower end of occlusion 62. As a result, the length of those portions of tubes 46 that are not along the path of occluding surfaces 90 and the volume of tubes 46 are reduced. Consequently, during start up of pump 40, the volume of air within tubes 46 that must first be pumped out and evacuated from the system is also reduced. Reducing the overall length of pumping tubes 46 also reduces the manufacturing costs of pump 40.

Figure 8:
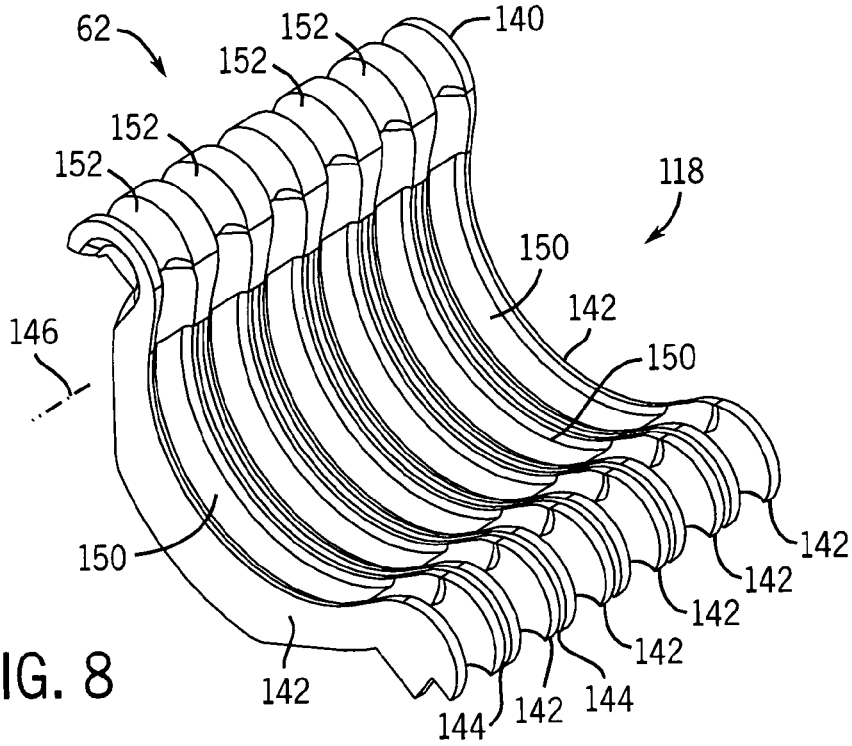
FIG. 8 is a top perspective view of an occlusion of the peristaltic pump of FIG. 2.
Figure 9:
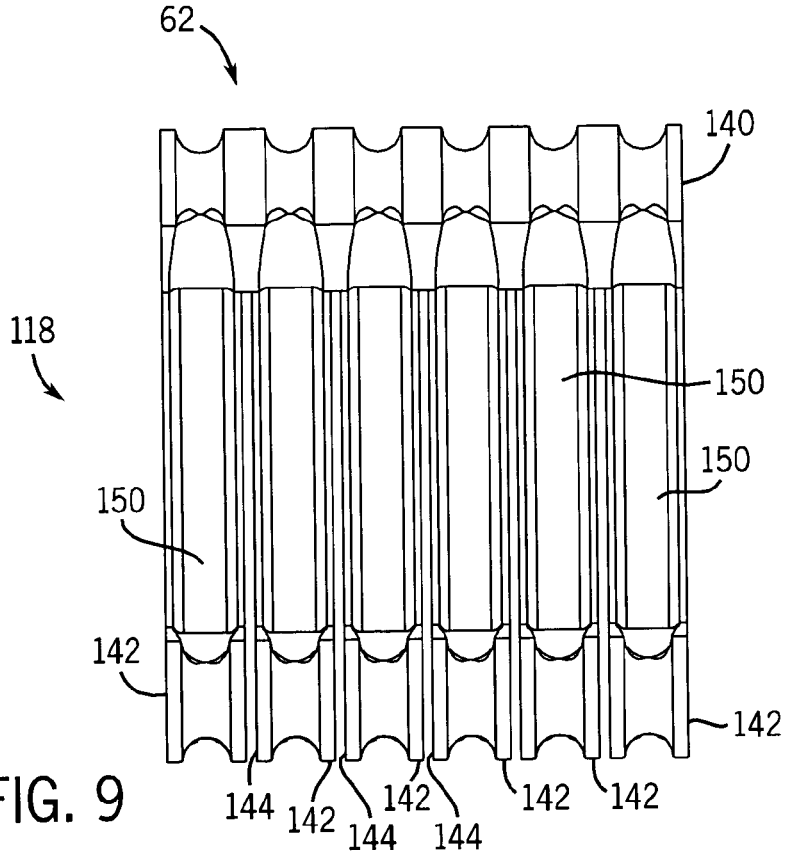
FIG. 9 is a front elevational view of the occlusion of FIG. 8.

Occlusion 62 is supported by holder 56 opposite to occluding surfaces 90. As shown by FIGS. 8 and 9, occlusion 62 includes base portion 140 and occlusion fingers 142. Base portion 140 comprises a structure interconnecting each of fingers 142 such that occlusion 62 is a single unit. As a result, occlusion 62 and its plurality of fingers 142 may be quickly and easily assembled and mounted in position opposite occluding surfaces 90. As previously noted, base portion 140 includes openings 106 which receive teeth 105 of holder 56 to couple occlusion 62 to holder 56 and to ensure proper alignment of occlusion 62 and holder 56.

Occlusion fingers 142 extend from base portion 140 and provide surfaces against which occluding surfaces 90 compress pumping tubes 46. Each occlusion finger 142 is separated and spaced from an adjacent finger 142 by one or more gaps 144. Gaps 144 facilitate independent movement of fingers 142 relative to one another. In the particular embodiment illustrated, fingers 142 pivot generally about an axis 146 extending parallel to axis 76 about which occluding surfaces 90 rotate. Fingers 142 pivot about axis 146 which is adjacent to the circular path along which occluding surfaces 90 move. As a result, the overall length or dimension of each of fingers 142 may be reduced, enabling occlusion 62 and pump 40 to have a more compact arrangement of components.

As shown by FIG. 8, fingers 142 extend from base portion 140 along an arc centered about an axis parallel to axis 76 about which occluding surfaces 90 rotate. In the particular embodiment illustrated, fingers 142 arcuately extend about axis 76 and along the rotation path of occluding surfaces 90 for approximately 150°. In alternative embodiments, fingers 142 may extend about axis 176 by alternative extents. Because fingers 142 wrap about axis 76 and about the circular path along which occluding surfaces 90 move, the length of tubes 46 that are being compressed is increased while the overall compactness of occluding member 52 and occlusion 62 is maintained.

Further enhancing the compact relationship of occlusion 62 and occluding member 52, fingers 142 each include channels 150. Channels 150 extend along face 118 of occlusion 62 and merge with channels 152 formed on base portion 140. Channels 150 are configured to partially receive tubes 46. Channels 150 retain tubes 46 in position as tubes 46 are being compressed by occluding surfaces 90. As a result, fingers 142 and tubes 46 may be more closely arranged along axis 146.

In the particular embodiment illustrated in which tubes 46 have a generally uncompressed circular cross section, channels 150 have a corresponding circumferential shape. Alternatively, channels 150 may have other cross-sectional shapes. In still other embodiments, channels 150 may be replaced with one or more spaced partitions, tabs or projections configured to retain tubes 46 in place.

According to one embodiment, each of fingers 142 is integrally formed as part of a single unitary body with other fingers 142 and with base portion 140. The junction between fingers 142 and base portion 140 is formed from a material configured and dimensioned so as to form a living hinge along axis 146, enabling each of fingers 142 to slightly pivot or flex independent of one another from and about axis 146. In the particular embodiment illustrated, occlusion 62 is integrally formed as a single unitary body out of a polymeric material such as polycarbonate or Acrylonitrile-Butadiene-styrene (ABS) with an optional filler material such as glass or polytetra flouroethylene (TEFLON). Other suitable materials may alternatively be employed. Because occlusion 62 is integrally formed as a single unitary body, rather than fingers 142 being individually formed and individually mounted relative to occluding member 52, the resulting tolerance stack which causes inconsistent spacing between occlusion 62 and occluding member 52 is reduced. In particular, each individual component of an assembly may have varying dimensions due to manufacturing imprecision and variability. By reducing the number of components, occlusion 62 provides pump 40 with improved consistent spacing between each of fingers 142 and occluding member 52. In addition, manufacturing and assembly costs are also reduced.

Spring system 64 is held by holder 56 in engagement with occlusion 62. Spring system 64 includes base portion 160, prongs 162 and spring fingers 164. Base portion 160 supports each of spring fingers 164 and is coupled to holder 56 by prongs 162. Prongs 162 extend from base portion 160 to resiliently flex and to snap onto and about catches 108 of holder 56. As a result, spring system 64 is releasably coupled to holder 56 without fasteners, simplifying assembly and reducing manufacturing costs. In alternative embodiments, spring system 64 may be coupled to holder 56 by other snapping arrangements or fasteners. In still other embodiments, spring system 64 may be integrally formed as part of a single unitary body with holder 56.

Figure 7:
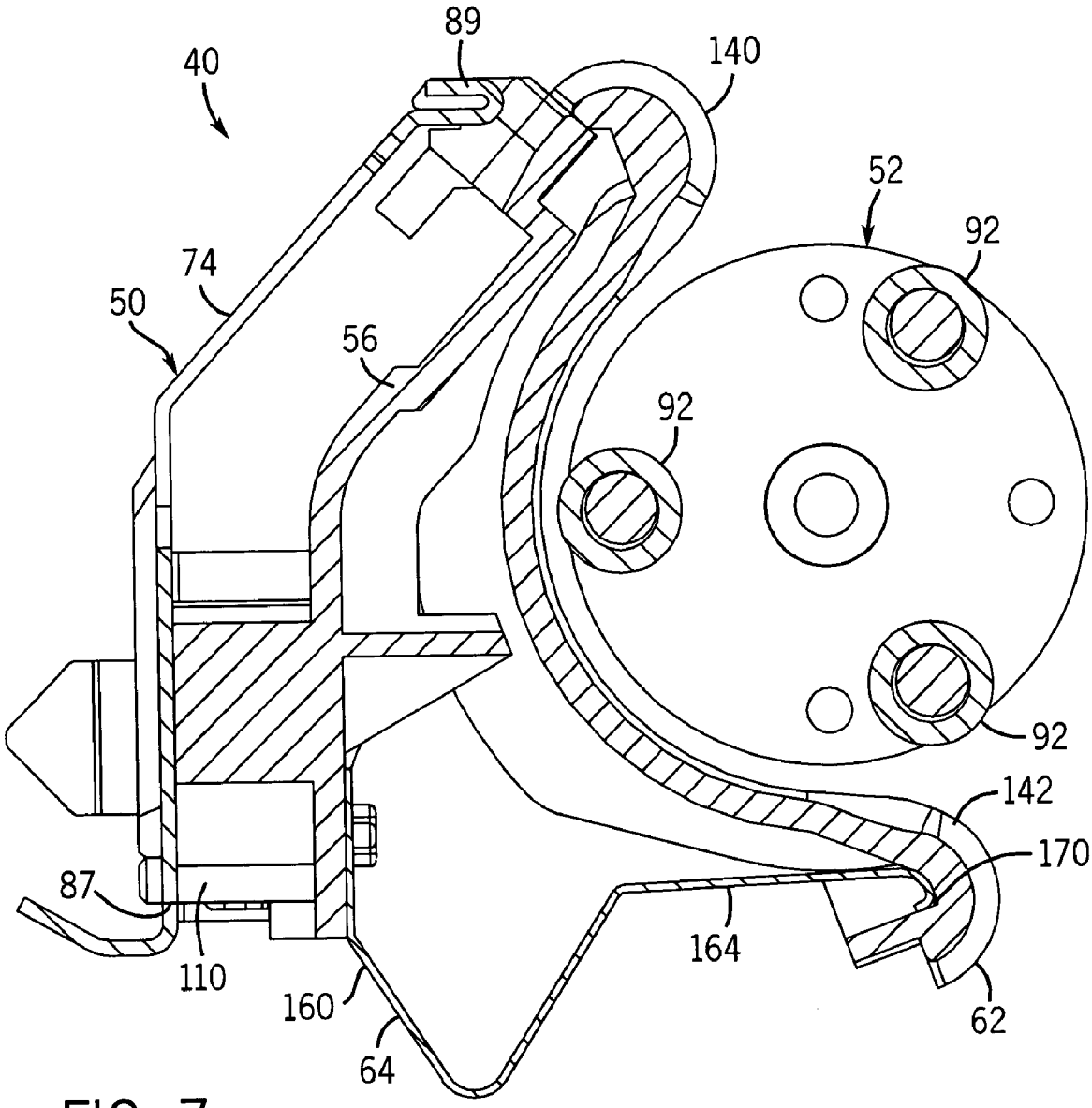
FIG. 7 is a sectional view of the peristaltic pump of FIG. 2.

Spring fingers 164 extend from base portion 160 and engage individual fingers 142 of occlusion 62. As shown by FIG. 7, each spring finger 164 is captured within a corresponding recess 170 formed within each finger 142 above each groove 132. Thus, spring system 64 is releasably coupled to occlusion 62 without fasteners, further simplifying assembly. In still other embodiments, spring system 64 may be fastened to occlusion 62 by fasteners.

Individual fingers 164 resiliently bias associated individual fingers 142 independent of other fingers 142 against movement away from occluding member 52. Because spring fingers 164 independently bias fingers 142 against movement away from occluding member 52, springs 164 independently and automatically adjust for any remaining tolerance stack or dimensional variations between the individual fingers 142 and the opposite occluding surfaces 90 of occluding member 52.

In the particular embodiment illustrated, spring fingers 164 are formed from a material dimensioned and generally provided with a spring force selected so as to just collapse pumping tube 46 based upon the resilience characteristics of tube 46. In particular, each tube 46 acts as its own spring when being engaged by occluding surfaces 90. This generally results in finger 142 being moved towards an individual spring finger 164. Because each spring finger 164 has a spring resistance selected based upon the characteristics of tube 46 so as to just collapse tube 46, a force balance is achieved between each spring finger 164 and its corresponding tube 46 which results in tubes 46 being ideally compressed to move fluid without being overly compressed. This force balancing eliminates the need for individually adjusting the position of each occlusion finger 142 to account for tolerance stack or dimensional variations.

In the particular embodiment illustrated, spring fingers 164 comprise leaf springs integrally formed as part of a single unitary body with base portion 160. Because spring fingers 164 are leaf springs, spring fingers 164 extend along fingers 142 in close proximity with the rear face of occlusion 62, enhancing the compact nature of pump 40. Spring system 64 is formed by stamping and deforming a metal such as steel, stainless steel, sheet metal. In alternative embodiments, spring system 64 may be formed from other materials such as polymers. Because spring system 64 is integrally formed as part of a single unitary body, the plurality of individual spring fingers 164 are more easily manufactured and are more easily assembled relative to occlusion 62. In addition, tolerance variations between individual spring fingers 164 are eliminated or reduced. In alternative embodiments, individual springs may be used in lieu of the integrally formed spring fingers 164.

Overall, embodiments of pump 40 may be compact and inexpensive to manufacture while consistently and reliably pumping fluid through a plurality of tubes without excessive wear of the tubes. Contributing to the compactness of pump 40, occlusion fingers 142 arcuately extend about occluding member 52 and are closely spaced to one another as a result of channels 150. The individual leaf springs forming spring fingers 164 require little space and are partially nested within the corresponding fingers 142. Holder 56 closely mates with occlusion 62 while guiding or funneling fluid conduits 42 and 44 along a back side of occlusion 62 such that conduits 42 and 44 exit and enter pump 40 from the same face of occlusion 62.

Contributing to ease of manufacture of pump 40, the individual occlusion fingers 142 and the plurality of individual spring fingers 164 are each integrally formed as a single unitary body, reducing the number of parts to be assembled. Holder 56, occlusion 62 and spring system 64 are each releasably coupled to one another and retained in place relative to one another without requiring any fasteners. Moreover, these three components are simply snapped, fitted or interlocked to one another. Likewise, holder 56 is stationarily coupled and retained in place relative to retainer 74 without fasteners. Retainer 74 is also quickly and easily connected to side plates 70 and 72 without fasteners. By minimizing the required use of fasteners, pump 40 facilitates a partially tool-less assembly.

Contributing to the consistent and reliable fluid pumping by pump 40, fluid couplers 58 and 60 are supported adjacent to working face 118 of occlusion 62. As a result, the length of pumping tubes 46 is reduced to reduce the volume of air that must be evacuated at the beginning of every pumping cycle. This is in part facilitated because fluid couplers 60 are directly coupled to occlusion 62. Because fingers 142 are integrally formed as part of a single unitary body, more consistent spacing between fingers 142 and occluding member 52 is achieved by reducing tolerance stack. By better controlling the gap between each of fingers 142 and occluding surfaces 90, pump 40 better optimizes the volume of ink being pumped while reducing wear upon tubes 46. At the same time, the plurality of spring fingers 164 are configured so as to eliminate the need for individually adjusting the position of each of fingers 142 while still achieving optimum compression of tubes 46 to achieve optimum pumping of fluid.

Each of the aforementioned features, in combination with one another, provide synergistic benefits for peristaltic pump 40. However, each of the aforementioned features may alternatively be utilized in other pumps independent of some or all of the other features. For example, occlusion 62 may alternatively be provided by a plurality of individual fingers which are independently supported relative to occluding member 52 or which are mechanically hinged or pivoted to a separate base portion 140. In alternative embodiments, spring system 64 may comprise other forms of springs. Fluid couplers 58 and 60 may alternatively be supported at locations distant from face 118 of occlusion 62 or may be supported by other structures besides holder 56 or occlusion 62. Although peristaltic pump 40 is illustrated in conjunction with an image-forming device such as printer 20, peristaltic pump 40 may alternatively be utilized in various other applications in which fluid must be pumped such as in medical and health-related applications or manufacturing applications.

Although the present invention has been described with reference to the example embodiment, workers skilled in the art will recognize that changes may be made in form and detail without departing from the spirit and scope of the invention. Because the technology of the present invention is relatively complex, not all changes in the technology are foreseeable. The present invention described with reference to the example embodiment and set forth in the following claims is manifestly intended to be as broad as possible. For example, unless specifically otherwise noted, the claims reciting a single particular element also encompass a plurality of such particular elements.

What is claimed is:

1. A peristaltic pump comprising:

a plurality of movable occluding surfaces;

a plurality of independently movable occlusion fingers opposite the occluding surfaces, wherein the plurality of fingers are integrally formed as a single unitary body; and a plurality of springs supported so as to independently resiliently bias the plurality of occlusion fingers.

2. The pump of claim 1, wherein the springs comprise leaf springs.

3. The pump of claim 1, wherein the springs are integrally funned as part of a single unitary body.

4. The pump of claim 1 including rollers rotatably supported so as to be adapted to extend proximate tubes, wherein the rollers provide the occluding surfaces.

5. The pump of claim 1, wherein each finger includes a channel configured to partially receive a tube.

6. The pump of claim 1, wherein the fingers extend along an arc.

7. The pump of claim 1 including fluid couplers supported adjacent each of the occlusion fingers.

8. The pump of claim 1 including a channeling member supported proximate the fingers and configured to channel at least one tube.

9. The pump of claim 1, wherein the fingers are integrally molded as a single unitary body out of a polymeric material.

10. The pump of claim 1, wherein the fingers pivot about a common axis.

11. The pump of claim 1, wherein the occluding surfaces are configured to move along a path into and out of engagement with tubes and wherein the fingers pivot about a substantially common axis adjacent the path.

12. The pump of claim 1, wherein the occluding surfaces rotate about a first common axis and wherein the springs pivot about a second axis parallel to the first axis.

13. The pump of claim 1, wherein the occluding surfaces are configured to move along a path into and out of engagement with tubes, wherein each of the fingers has a first end and a second opposite end and wherein the first end and the second opposite end extend adjacent to the path.

14. The pump of claim 1 including:

fluid conduits con figured to be fluidly coupled to the pumping tubes; and a holder coupled to the fingers and the springs, wherein the holder includes a surface against which the fluid conduits extend.

15. The pump of claim 14, wherein the holder is removably and directly coupled to the fingers without fasteners.

16. The pump of claim 15, wherein the springs are removably and directly coupled to the holder without fasteners.

17. The pump of claim 16, wherein the springs are releasably coupled to and engaging to the fingers without fasteners.

18. The pump of claim 14 including fluid couplers coupled to and supported by the holder.

19. The pump of claim 14 including a channeling member extending from the surface and configured to channel at least one tube.

20. The pump of claim 1 including pumping tubes, wherein the occluding surfaces move along a path into and out of engagement with the tubes and wherein the pump further includes:

first fluid couplers connected to a first end of the pumping tubes adjacent the pat; and second fluid couplers connected to a second end of the pumping tubes adjacent the path.

21. The pump of claim 1 including fluid couplers coupled to and supported by fingers.

22. The pump of claim 1 including a tube channeling member supported proximate the fingers.

23. The pump of claim 1 including:

pumping tubes; and first fluid conduits fluidly coupled to a first end of the pumping tubes, wherein the pumping tubes have a first flow area of cross sectional flow area and wherein the first fluid conduits have a second smaller interior cross sectional flow area.

24. The pump of claim 23 including fluid couplers between the pumping tubes and the first fluid conduits.

25. The pump of claim 23, wherein the pumping tubes extend on a first side of the fingers and wherein the first fluid conduits extend on a second opposite side of the fingers.

26. The pump of claim 25 including second fluid conduits fluidly coupled to a second opposite end of the pumping tubes, wherein the second fluid conduits extend on the second side of the fingers.

27. The pump of claim 23 including second fluid conduits fluidly connected to a second opposite end of the pumping tubes.

28. The pump of claim 27, wherein the pumping tubes each have a first interior cross sectional flow area and wherein the second fluid conduits each have a second smaller interior cross sectional flow area.

29. The pump of claim 23 including fluid sensors at least proximate an interior of the pumping tubes.

30. The pump of claim 29, including fluid couplers connected to the pumping tubes, wherein the fluid sensors are located within the fluid couplers.

31. A peristaltic pump comprising:

movable occluding surfaces;

independently movable occlusion fingers opposite the occluding surfaces;

springs independently resiliently biasing the plurality of occlusion fingers, wherein the springs are integrally formed as part of a single unitary body; and a drive system configured to move the occluding surfaces.

32. A peristaltic pump comprising:

movable occluding surfaces;

independently movable occlusion fingers opposite the occluding surfaces;

springs independently resiliently biasing the occlusion fingers; and fluid couplers supported by the fingers.

33. A peristaltic pump comprising:

pumping tubes, each tube having a flexible wall portion;

movable occluding surfaces on a first side of the pumping tubes;

independently movable occlusion fingers on a second opposite side of the tubes;

springs independently resiliently biasing the occlusion fingers towards the pumping tubes;

a drive system configured to move the occluding surfaces so as to compress the tubes against the fingers; and fluid couplers connected to the pumping tubes, wherein at least one of the fluid couplers includes a fluid sensor.

34. A peristaltic pump comprising:

movable occluding surfaces;

an occlusion including:

a base portion; and occlusion fingers pivotally coupled to the base portion and extending opposite the surfaces;

a holder releasably and directly coupled to the base portion of the occlusion without fasteners;

a spring system including:

a base portion releasably and directly coupled to the holder without fasteners; and springs extending from the base portion into engagement with the fingers; and a drive system configured to move the occluding surfaces.

35. A peristaltic pump comprising:

fluid passages, wherein each fluid passage includes a compressible portion;

a first unit having independently movable surfaces adjacent the compressible portion of each of the fluid passages;

a second unit integrally formed as a single unitary body having biasing means for resiliently biasing the independently movable surfaces against movement away from the compressible portions; and means for compressing the compressible portions of the fluid passages to move fluid along the fluid passages.

36. An occlusion for use in a peristaltic pump, the occlusion comprising:

independently movable occlusion fingers, wherein the fingers are integrally formed as a single unitary body and, wherein each of the fingers includes means for retaining a tube in place.

37. The occlusion of claim 36, wherein each of the fingers is configured to support a fluid coupler.

38. A printer comprising:

an ink dispensing pen;

ink reservoirs; and a pump comprising:

pumping tubes in fluid communication with the ink reservoirs and the ink dispensing pen, each tube having a flexible wall portion;

movable occluding surfaces on a first side of the pumping tubes;

independently movable occlusion fingers on a second opposite side of the pumping tubes, wherein the fingers are integrally formed as a single unitary body; and springs independently resiliently biasing the occlusion fingers towards the pumping tubes; and a drive system configured to move the occluding surfaces so as to compress the tubes against the fingers.

39. An occlusion for use in a peristaltic pump, the occlusion comprising:

independently movable occlusion fingers, wherein the fingers are integrally formed as a single unitary body and wherein each of the fingers is configured to support a fluid coupler.

* * * * *